US007284601B2

(12) United States Patent
Bell et al.

(10) Patent No.: US 7,284,601 B2
(45) Date of Patent: Oct. 23, 2007

(54) CASING CONVEYED WELL PERFORATING APPARATUS AND METHOD

(75) Inventors: Matthew Robert George Bell, Houston, TX (US); Eugene Murphy, Houston, TX (US); Edward Paul Cernocky, Mandeviille, LA (US); Christopher Burres, Houston, TX (US); Aron Ekelund, Houston, TX (US); Allen Lindfors, Inyokern, CA (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/902,209

(22) Filed: Jul. 29, 2004

(65) Prior Publication Data

US 2006/0000613 A1 Jan. 5, 2006

Related U.S. Application Data

(62) Division of application No. 10/339,225, filed on Jan. 9, 2003, now Pat. No. 6,962,202.

(51) Int. Cl.
*E21B 43/116* (2006.01)
*F42B 3/02* (2006.01)

(52) U.S. Cl. ..... 166/55; 175/2; 102/321; 102/319

(58) Field of Classification Search ..... 173/2; 166/55.2, 55; 102/313, 319, 321, 321.1
See application file for complete search history.

(56) References Cited

U.S. PATENT DOCUMENTS 2,667,836 A 2/1954 Church et al. ..... 102/20
2,837,027 A 6/1958 Martin ..... 102/20
3,276,371 A * 10/1966 Newman et al. ..... 102/317
3,351,012 A 11/1967 Wilson ..... 102/28
3,468,386 A 9/1969 Johnson ..... 175/4.6
3,734,018 A * 5/1973 Gillingham ..... 102/307

(Continued)

FOREIGN PATENT DOCUMENTS

EP 0694157 B1 8/2001

(Continued)

OTHER PUBLICATIONS

Ron Baker, "A Primer of Oilwell Drilling," Foruth Edition, First Edition published 1951, Fourth Edition published 1979, pp. 59-61, The University of Texas at Austin.

(Continued)

*Primary Examiner*—David Bagnell
*Assistant Examiner*—Shane Bomar

(57) ABSTRACT

Disclosed is a device and method for externally perforating a well-bore casing. The perforating apparatus is attached to the outside of the casing itself and is conveyed along with the casing when it is inserted into the well bore. The perforation is accomplished using two groups of charges which are contained in protective pressure chambers which are arranged radially around the outside of the wellbore casing. The pressure chambers form longitudinally extending ribs which conveniently serve to center the casing within the well bore. One group of charges is aimed inward in order to perforate the casing. A second group is aimed outward in order to perforate the formation. In an alternative embodiment, only one group of bi-directional charges is provided.

4 Claims, 11 Drawing Sheets

U.S. PATENT DOCUMENTS 3,735,705 A 5/1973 Hudson, Jr. et al. ..... 102/28 R
3,830,303 A 8/1974 Perkins ..... 166/297
4,140,188 A 2/1979 Vann ..... 175/4.51
4,371,044 A * 2/1983 Willig et al. ..... 175/4.6
4,391,337 A 7/1983 Ford et al. ..... 175/4.6
4,485,741 A * 12/1984 Moore et al. ..... 102/331
4,496,009 A 1/1985 DerMott et al.
4,538,680 A 9/1985 Brieger et al.
4,576,093 A 3/1986 Snyder ..... 102/200
4,615,268 A 10/1986 Nakano et al. ..... 102/217
4,619,333 A 10/1986 George
4,649,822 A 3/1987 Seeman ..... 102/275.1
4,768,597 A 9/1988 Lavigne et al.
4,777,878 A 10/1988 Johnson et al. ..... 102/202.5
4,790,383 A 12/1988 Savage et al.
4,850,438 A 7/1989 Regalbuto
4,884,506 A 12/1989 Guerreri
4,895,218 A 1/1990 Chen et al. ..... 181/116
4,911,251 A 3/1990 George et al.
4,917,187 A 4/1990 Burns et al.
4,924,952 A 5/1990 Schneider
4,951,744 A * 8/1990 Rytlewski ..... 175/4.57
4,969,525 A 11/1990 George et al.
5,031,517 A 7/1991 Yeh ..... 99/319
5,038,682 A 8/1991 Marsden ..... 102/220
5,050,672 A 9/1991 Huber et al.
5,090,321 A 2/1992 Abouav ..... 102/200
5,111,885 A 5/1992 Umphries ..... 166/297
5,131,465 A * 7/1992 Langston ..... 166/55.1
5,159,149 A 10/1992 Marsden ..... 102/217
5,212,495 A 5/1993 Winkel et al. ..... 343/872
5,224,556 A 7/1993 Wilson et al. ..... 175/4.53
5,279,228 A 1/1994 Ayer ..... 102/306
5,287,924 A 2/1994 Burleson et al.
5,295,544 A 3/1994 Umphries ..... 166/297
5,355,957 A 10/1994 Burleson et al.
5,413,045 A 5/1995 Miszewski ..... 102/201
5,423,382 A 6/1995 Barton et al.
5,436,791 A 7/1995 Turano et al. ..... 361/253
5,445,228 A 8/1995 Rathmell et al. ..... 175/4
5,467,823 A 11/1995 Babour et al. ..... 166/250.01
5,479,860 A 1/1996 Ellis ..... 102/313
5,505,134 A 4/1996 Brooks et al. ..... 102/203.7
5,513,703 A 5/1996 Mills et al. ..... 166/55.1
5,530,358 A 6/1996 Wisler et al. ..... 324/338
5,660,232 A 8/1997 Reinhardt ..... 166/297
5,706,892 A 1/1998 Aeschbacher, Jr. et al. ... 166/66
5,765,641 A 6/1998 Shy et al. ..... 166/292
5,767,437 A 6/1998 Rogers ..... 102/200
5,807,302 A 9/1998 Wandel ..... 604/8
5,829,538 A 11/1998 Wesson et al. ..... 175/4.6
5,943,954 A 8/1999 Otomo ..... 101/120
5,995,449 A 11/1999 Green et al. ..... 367/83
6,009,947 A 1/2000 Wilson et al.
6,082,450 A 7/2000 Snider et al.
6,085,843 A 7/2000 Edwards et al.
6,234,081 B1 5/2001 Neyer ..... 102/202.5
6,247,408 B1 6/2001 Andrejkovies et al. ..... 102/200
6,386,108 B1 5/2002 Brooks et al. ..... 102/217
6,386,288 B1 5/2002 Snider et al. ..... 166/298
6,464,011 B2 10/2002 Tubel ..... 166/313
6,536,524 B1 3/2003 Snider
6,557,636 B2 5/2003 Cernocky et al. ..... 166/297
6,577,244 B1 6/2003 Clark et al. ..... 340/854.4
6,702,039 B2 * 3/2004 Parrott et al. ..... 175/4.6
6,710,600 B1 3/2004 Kopecki et al. ..... 324/338
6,752,083 B1 6/2004 Lerche et al. ..... 102/202.7
6,755,249 B2 6/2004 Robison et al. ..... 166/262
2002/0080620 A1 6/2002 Christiansen ..... 362/528
2002/0125011 A1 9/2002 Snider et al. ..... 166/297
2003/0000411 A1 1/2003 Cernocky et al. ..... 102/200
2003/0000703 A1 1/2003 Cernocky et al. ..... 166/297
2003/0001753 A1 1/2003 Cernocky et al. ..... 340/853.1
2005/0109508 A1 * 5/2005 Vella et al. ..... 166/297

FOREIGN PATENT DOCUMENTS

FR 2688583 9/2003
JP 5149700 6/1993
RU 2001250 10/1993
SU 1657627 6/1991
WO 9508866 3/1995
WO WO 9509966 4/1995
WO WO 9524608 9/1995
WO 00/05774 2/2000
WO 00/65195 11/2000

OTHER PUBLICATIONS

Perdue, Jeanne, "Well Construction: Thinking outside the casing," February 2002, pp. 1-5, Hart's E&P Net (Chemical Week Associates, New York, New York).

*Drilling and Bit Technology: Casing-Conveyed performating tested*; Barry Rustad, et al., Feb. 2000; pp. 85-87.

*Leaving Frwer Footprints, Shell International Exploration and Production*:, Dec. 1, 2002; p. 1-12.

* cited by examiner

CASING CONVEYED WELL PERFORATING APPARATUS AND METHOD

CROSS-REFERENCE TO RELATED APPLICATIONS

This application is a divisional of Ser. No. 10/339,225, filed Jan. 9, 2003, now U.S. Pat. No. 6,962,202 entitled "Casing Conveyed Perforation Apparatus and Method." This application is also related to U.S. patent application Ser. No. 10/902,203 entitled "Casing Conveyed Perforation Apparatus and Method"; Ser. No. 10/902,209 entitled "Casing Conveyed Perforation Apparatus and Method"; Ser. No. 10/902,206 entitled "Casing Conveyed Perforation Apparatus and Method"; and Ser. No. 10/840,589 entitled "Casing Conveyed Perforation Apparatus and Method"

STATEMENT REGARDING FEDERALLY SPONSORED RESEARCH OR DEVELOPMENT

None.

BACKGROUND OF THE INVENTION

1. Field of the Invention

The present invention relates to a method and apparatus for perforating the walls of a well bore and, in particular, to a method and apparatus which will provide accurate and controlled perforating of a tubular casing during the process of creating a subterranean well. More specifically, a perforating assembly is deployed along with the casing to be used for the perforation and stimulation of zones for the ultimate withdrawal of hydrocarbons therefrom or injection of fluids (liquid or gas) for the purpose of voidage replacement or stimulation of the production interval wherein said perforating assembly comprises a frame supporting a plurality of pressure chambers configured as longitudinally extending ribs which conveniently serve to centralize the casing within the well bore.

2. Description of Related Art

Well bores are typically drilled using a drilling string with a drill bit secured to the lower free end and then completed by positioning a casing string within the well bore. The casing increases the integrity of the well bore and provides a flow path between the surface and selected subterranean formations for the withdrawal or injection of fluids.

Casing strings normally comprise individual lengths of metal tubulars of large diameter. These tubulars are typically secured together by screw threads or welds. Conventionally, the casing string is cemented to the well face by circulating cement into the annulus defined between the outer surface of the casing string and the well-bore face. The casing string, once embedded in cement within the well, is then perforated to allow fluid communication between the inside and outside of the tubulars across intervals of interest. The perforations allow for the flow of treating chemicals (or substances) from the inside of the casing string into the surrounding formations in order to stimulate the production or injection of fluids. Later, the perforations are used to receive the flow of hydrocarbons from the formations so that they may be delivered through the casing string to the surface, or to allow the continued injection of fluids for reservoir management or disposal purposes.

Perforating has conventionally been performed by means of lowering a perforating gun on a carrier down inside the casing string. Once a desired depth is reached across the formation of interest and the gun secured, it is fired. The gun may have one or many charges thereon which are detonated using a firing control, which is activated from the surface via wireline or by hydraulic or mechanical means. Once activated, the charge is detonated to penetrate and thus perforate both the casing, cement, and to a short distance, the formation. This establishes the desired fluid communication between the inside of the casing and the formation. After firing, the gun is either raised and removed from the well bore, left in place, or dropped to the bottom thereof.

Examples of the known perforating devices can be found in U.S. Pat. No. 4,538,680 to Brieger et al; U.S. Pat. No. 4,619,333 to George; U.S. Pat. No. 4,768,597 to Lavigne et al; U.S. Pat. No. 4,790,383 to Savage et al; U.S. Pat. No. 4,911,251 to George et al; U.S. Pat. No. 5,287,924 to Burleson et al; U.S. Pat. No. 5,423,382 to Barton et al; and U.S. Pat. No. 6,082,450 to Snider et al. These patents all disclose perforating guns that are lowered within a casing string carrying explosive charges, which are detonated to perforate the casing outwardly as described above. This technique provided the advantage of leaving the inside of the casing relatively unobstructed since debris and ragged edges would be outwardly directed by the detonations of the charges.

U.S. Pat. No. 6,386,288 issued to Snider et al, describes an attempt to perforate a tubular from the outside. The technique in Snider involves the use of a perforating gun separate from and exterior to the casing to be perforated as can be seen in FIGS. 1-3.

Referring to FIG. 1, the Snider perforating gun assembly 20 may be seen positioned within well bore 2 adjacent the exterior of casing 12. The gun 20 is secured to casing 12 by metal bands (not shown), which are wrapped around both casing 12 and gun 20. Assembly 20 is constructed of metal. An electric line 18 extends from a power source (not illustrated) at the surface 4 to ignite the gun 20. Snider discloses that other suitable control systems for igniting the explosive charge(s) contained in perforating gun assembly 20, such as hydraulic lines connected to a suitable source of pressurized hydraulic fluid (liquid or gas) or electromagnetic or acoustic signaling and corresponding receivers connected to the perforating gun assemblies for wave transmissions through the casing, soil and/or well bore fluids, may also be used. Snider indicates that conventional means are used to secure the lines to the casing at desired intervals.

Referring to FIG. 2, the Snider gun 20 has two explosive charges, 22 and 26, contained therein, which are aimed toward casing 12. Charges 22 and 26 are axially spaced apart within assembly 20 and which, although oriented at slightly different angles, are both aimed toward casing 12. As can best be seen in FIG. 3, upon transmission of electrical current via line 18, explosive charge 22 detonates and fires a shaped charge along path 24 creating perforations 11 and 14 in the wall of casing 12. Explosive charge 26 detonates and fires a shaped charge along path 28 creating perforations 15 and 16.

When the Snider gun is detonated, portions of the gun act in a manner similar to shrapnel to perforate the casing string. This has disadvantages. First, the resulting perforations 11, 14, 15, and 16 tend to be ragged. Especially perforations 14 and 16—the ones furthest away from the gun. This is because the perforations at these remote locations 14, 16 are created using not only the shaped charge itself, but also portions of the casing blasted from locations 11 and 15 when the proximate perforations were created. As a result, remote perforations 14 and 16 will be much less precise than proximate perforations 11 and 15.

A second disadvantage is that all of the charges in the Snider gun are fired from the same point of origin relative to the circumference of the casing. Because of this, the perforations created are significantly asymmetrical. As can be seen in FIG. 3, perforations 11 and 15 are very close together, whereas perforations 14 and 16 are far apart.

The asymmetrical nature and raggedness of the perforations will cause the well to have poor in-flow properties when the well is placed into production. Additionally, the raggedness of casing perforations 11 and 15 may occur to the extent that the ruptured inner surface of the casing could damage or even prevent passage of down-hole tools and instruments. The structural integrity of the casing string might even be compromised to a degree.

A third disadvantage inherent in the method disclosed in Snider relates to the size of the cement-filled annulus created between the outer surface of the casing 12 and the inner surface of the bore hole. See FIG. 2. This is because assembly 20 is unreasonably large, and thus, the profile of the well bore and casing 12 are not concentric. Rather, the center axis of the casing 12 is offset a great deal from the center axis of the well bore to create sufficient space that the assembly 20 and a flapper housing (not pictured) may be received therein. The flapper housing is disposed below the gun and is used to seal off lower zones after they have been perforated. The annular gap must be made even larger if multiple guns are to be employed at a given depth. Because this annular gap must be made larger with the Snider method, either the bore size must be made bigger, or the casing must be made smaller in diameter. Both of these solutions have disadvantages. Even a slight increase in bore size will result in significant additional drilling costs. Reducing the casing diameter 12, however, will diminish the conduits flow abilities. Therefore, because deploying the Snider gun requires extra space outside the casing, the user must either pay additional drilling costs or suffer the consequence of reduced conduction of processing fluids.

A fourth disadvantage is that the Snider gun assembly is constructed of metal. This is disadvantageous in that when the guns are fired, metal fragments from the assembly 20 will cause collateral damage thus impairing the flow performance of the perforation tunnel. This could be avoided if a less destructive material were used.

Frequently a well penetrates multiple zones of the same formation and/or a plurality of hydrocarbon bearing formations of interest. It is usually desirable to establish communication with each zone and/or formation of interest for injection and/or production of fluids. Conventionally, this has been accomplished in any one of several ways. One way is to use a single perforating gun that is conveyed by wireline or tubing into the well bore and an explosive charge fired to perforate a zone and/or formation of interest. This procedure is then repeated for each zone to be treated and requires running a new perforating gun into the well for each zone and/or formation of interest.

One alternative is to have a single perforating gun carrying multiple explosive charges. This multiple explosive charge gun is conveyed on wireline or tubing into the well and, as the gun is positioned adjacent to each zone and/or formation of interest, selected explosive charges are fired to perforate the adjacent zone and/or formation. In another alternative embodiment, two or more perforating guns, each having at least one explosive charge, are mounted spaced apart on a single tubing, then conveyed into the well, and each gun is selectively fired when positioned opposite a zone and/or formation of interest. When the select firing method is used, and the zone and/or formation of interest are relatively thin, e.g., 15 feet or less, the perforating gun is positioned adjacent the zone of interest and only some of the shaped charges carried by the perforating gun are fired to perforate only this zone or formation. The gun is then repositioned, by means of the tubing, to another zone or formation and other shaped charges are fired to perforate this zone or formation. This procedure is repeated until all zones and/or formations are perforated, or all of the shaped explosive charges detonated, and the perforating gun is retrieved to the surface by means of the tubing.

However, the necessity of tripping in and out of the well bore to perforate and stimulate each of multiple zones and/or formations is time consuming and expensive. In view of this, multiple zones and/or formations are often simultaneously stimulated, even though this may result in certain zones and/or formations being treated in a manner more suitable for an adjacent zone and/or formation.

Another disadvantage in conventional systems regards the deployment of sensitive transmission lines outside the casing. It is often desirable to deploy a cable, fiber or tube along the length of a well bore for connection to, or to act directly as, a sensing device. Where such a device is deployed outside a casing and where that casing is subsequently perforated, there exists a substantial risk that the device will be damaged by being directly impinged upon by the jet created by an exploding charge because the cables are not fixed at a known location to prevent being hit by the charge. This risk is elevated if the perforating system is difficult to orient within the well bore. Thus, there is a need in the prior art for a method of protecting these sensitive transmission lines during perforation.

Thus, a need exists for (i) a modular perforation assembly which is conveyed by the casing as it is lowered within the well bore so that it eliminates the need to run perforating equipment in and out of the well when completing multiple zones and/or formations; (ii) that the assembly be externally-mounted in such a way that the casing will be centered rather than offset within the well bore upon its installation; (iii) that the assembly create perforations which are equally spaced and precise so that the perforated casing will have desirable in-flow characteristics and not be obstructed; (iv) that the charges of the assembly are fired from a plurality of points of origin about the periphery of the casing, but are limited in power so that they will penetrate the casing only once and will cause no damage to the rest of the casing; (v) that the perforations created do not significantly compromise the structural integrity of the casing; (vi) that the charges are fired in opposite directions so that different charges may be fired to rupture the casing wall while other more powerful charges are used to perforate the formation; (vii) a frame for the assembly that is easily constructed and will protectively maintain the charges on the outside of the casing in a dry and pressure-controlled environment; (viii) that the portions of the frame through which the charges are blasted into the formation be constructed of a less-damaging material than metal in order to minimize collateral formation damage that might be caused by the charges, and (ix) that a method be provided that enables perforation to be accomplished without damaging sensitive casing-conveyed transmission lines.

SUMMARY OF THE INVENTION

It is an object of the present invention to provide a process and apparatus for completing a well wherein the casing is perforated to provide for fluid communication through the wall of the casing by means of a perforating gun assembly which is attached to the exterior of the casing string and is deployed along with the casing string into the well bore.

It is a further object of the present invention that the externally mounted perforating assembly results in centering the casing within the well bore upon its installation.

It is a further object of the present invention to provide a perforating gun arrangement in which the perforations created are not imprecise, ragged, and asymmetrical, but instead, equally spaced and precise so that the perforated casing will have desirable in-flow characteristics and not be obstructed.

It is a further object of the present invention to provide a gun arrangement in which the guns are fired from a plurality of points of origin about the periphery of the casing, but are limited in power so that they will penetrate the casing only once and will cause no damage to the rest of the casing.

It is a further object of the present invention that the perforations created do not significantly compromise the structural integrity of the casing.

It is a further object of the invention to provide a gun assembly in which separate charges are fired in opposite directions so that different charges may be fired to rupture the casing wall while other more powerful charges are used to perforate the formation.

It is a further object of the present invention to provide a frame for the gun assembly which is easily constructed and will protectively maintain the charges on the outside of the casing in pressure chambers during and after deployment in dry condition at atmospheric pressure.

It is a further object of the present invention to provide a gun assembly that, despite the fact that its charges are mounted externally to the frame, has a slim overall profile and does not significantly increase borehole size requirements. More specifically, that the charges and associated frame on the casing be arranged in longitudinal ribs dispersed about the outside of the casing so that the gap or cement-filled annulus between the outer surface of the casing and the well bore does not have to be unusually large.

It is a further object of the present invention that the portions of the frame through which the charges are blasted into the formation are constructed of a composite material to minimize undesirable collateral damage.

It is a further object of the present invention to provide a single charge capable of firing perforating explosive jets in two opposing directions, the explosive charge in one direction being selected for optimal perforation of the casing and the explosive charge in the other direction being selected for optimal perforation of the formation.

It is a further object of the present invention to provide a method of protecting sensitive transmission lines during perforation of the casing.

BRIEF DESCRIPTION OF THE DRAWINGS

The present invention is described in detail below with reference to the attached drawing figures, wherein.

DETAILED DESCRIPTION OF THE INVENTION

The present invention provides a device and method for externally perforating a well-bore casing. The perforating apparatus is attached to the outside of the casing itself and is conveyed along with the casing when it is inserted into the well bore.

Figure 1:
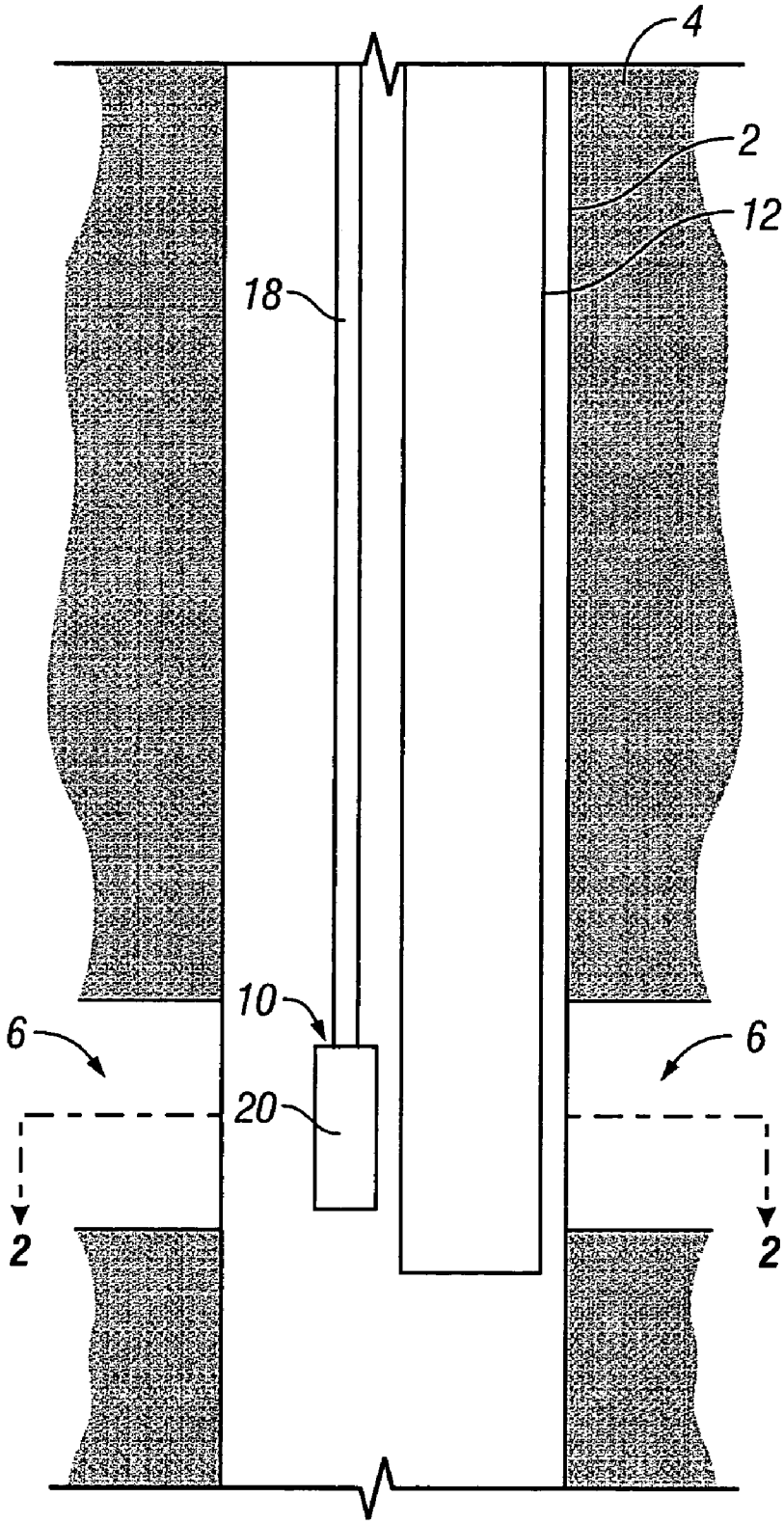
FIG. 1 (Prior Art)
FIG. 1 is a sectional side view of the Snider perforating gun assembly as positioned in a subterranean well.
Figure 3:
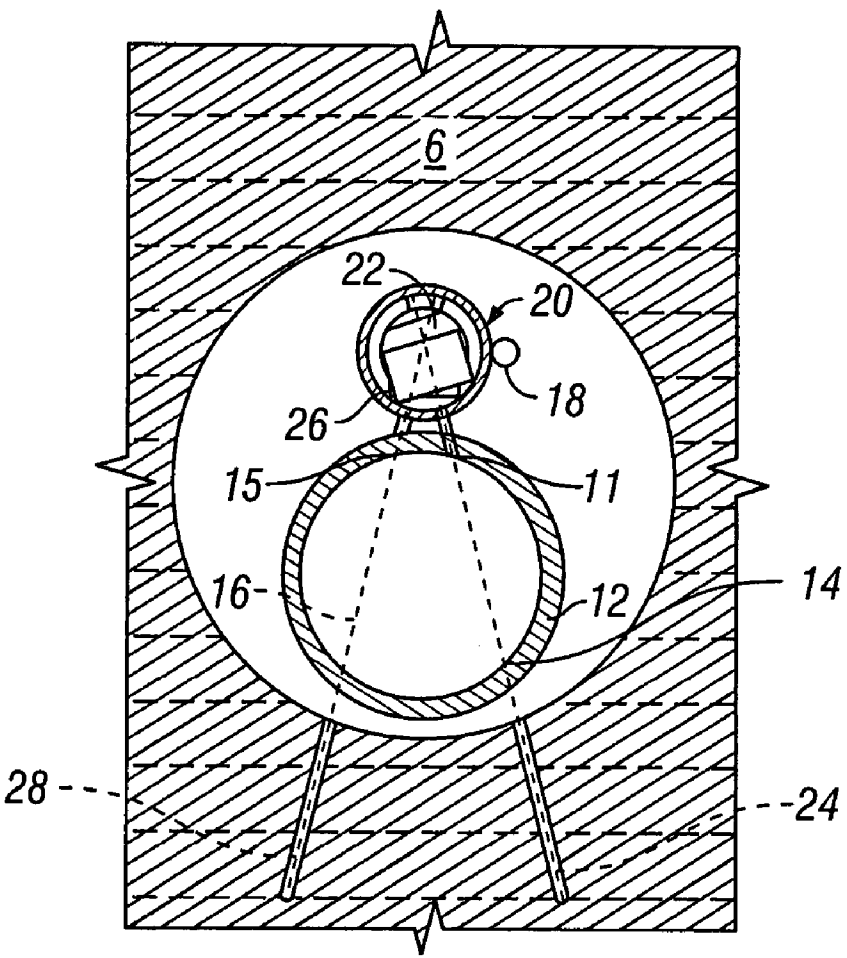
FIG. 3 (Prior Art)
FIG. 3 is a cross-sectional view of the Snider perforating gun assembly as positioned within a subterranean well bore taken along line 2-2 of FIG. 1 after the explosive charges of the perforating gun have been detonated.
Figure 2:
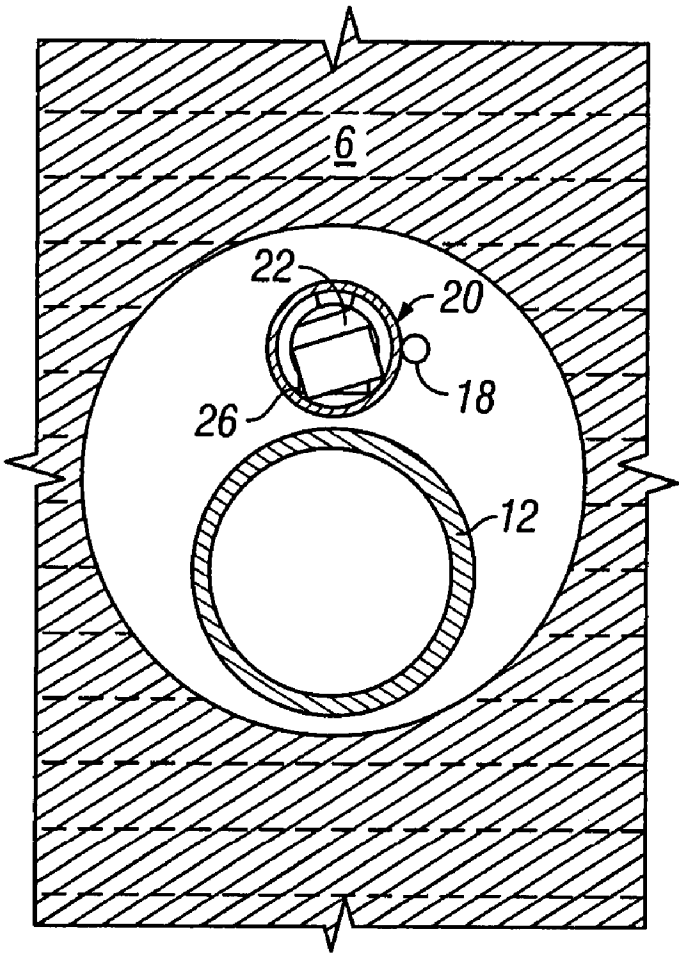
FIG. 2 (Prior Art)
FIG. 2 is a cross-sectional view of the Snider perforating gun assembly as positioned within a subterranean well bore taken along line 2-2 of FIG. 1.
Figure 4:
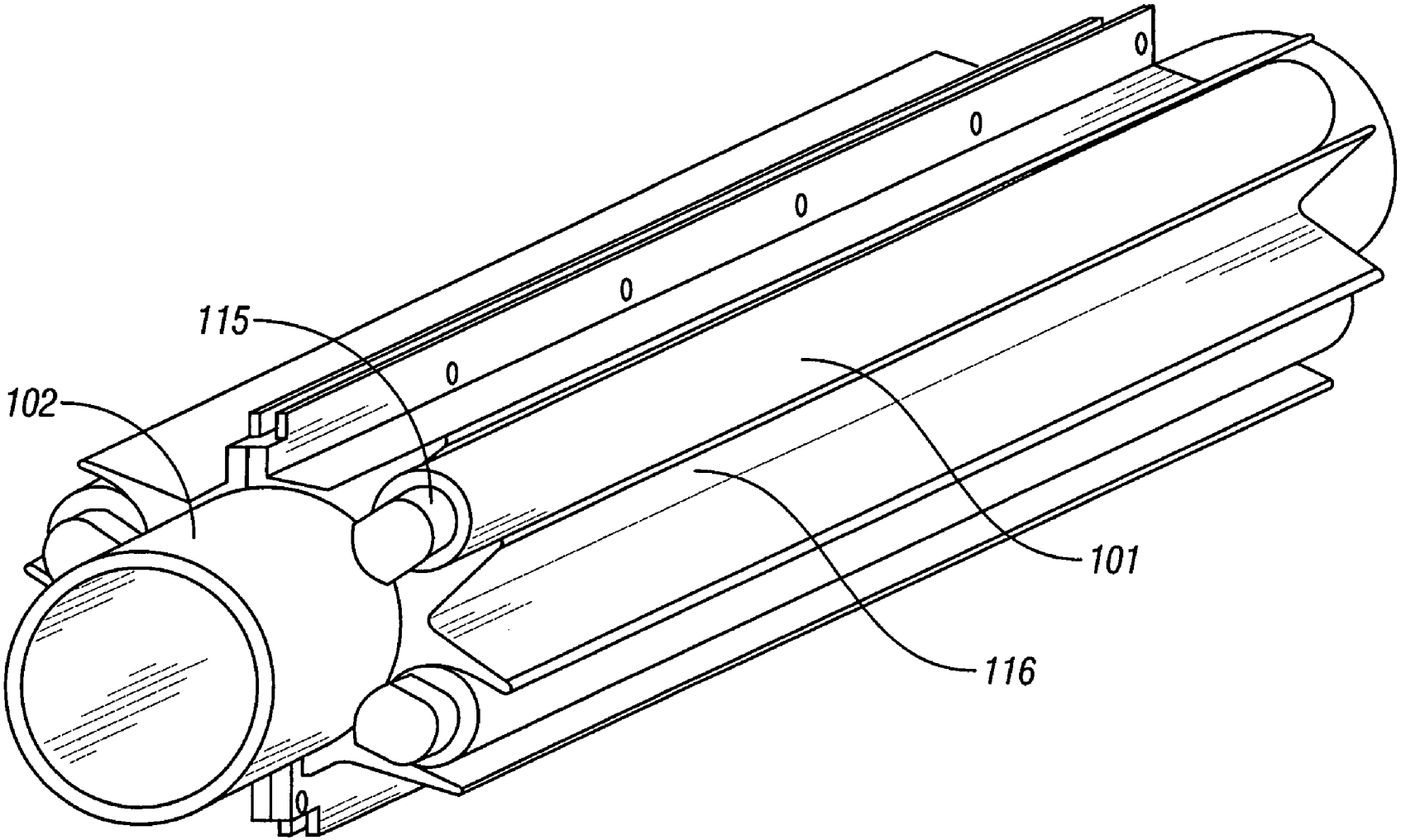
FIG. 4 is a perspective view of the casing with the carrier and pressure chambers of the present invention mounted thereon.

Referring first to FIG. 4, The casing conveyed perforating (CCP) system of the present invention comprises a plurality of pressure chambers 101 which are arranged radially around the outside of a well-bore casing 102. These pressure chambers 101 are used to protect the relatively sensitive components contained therein.

Figure 13:
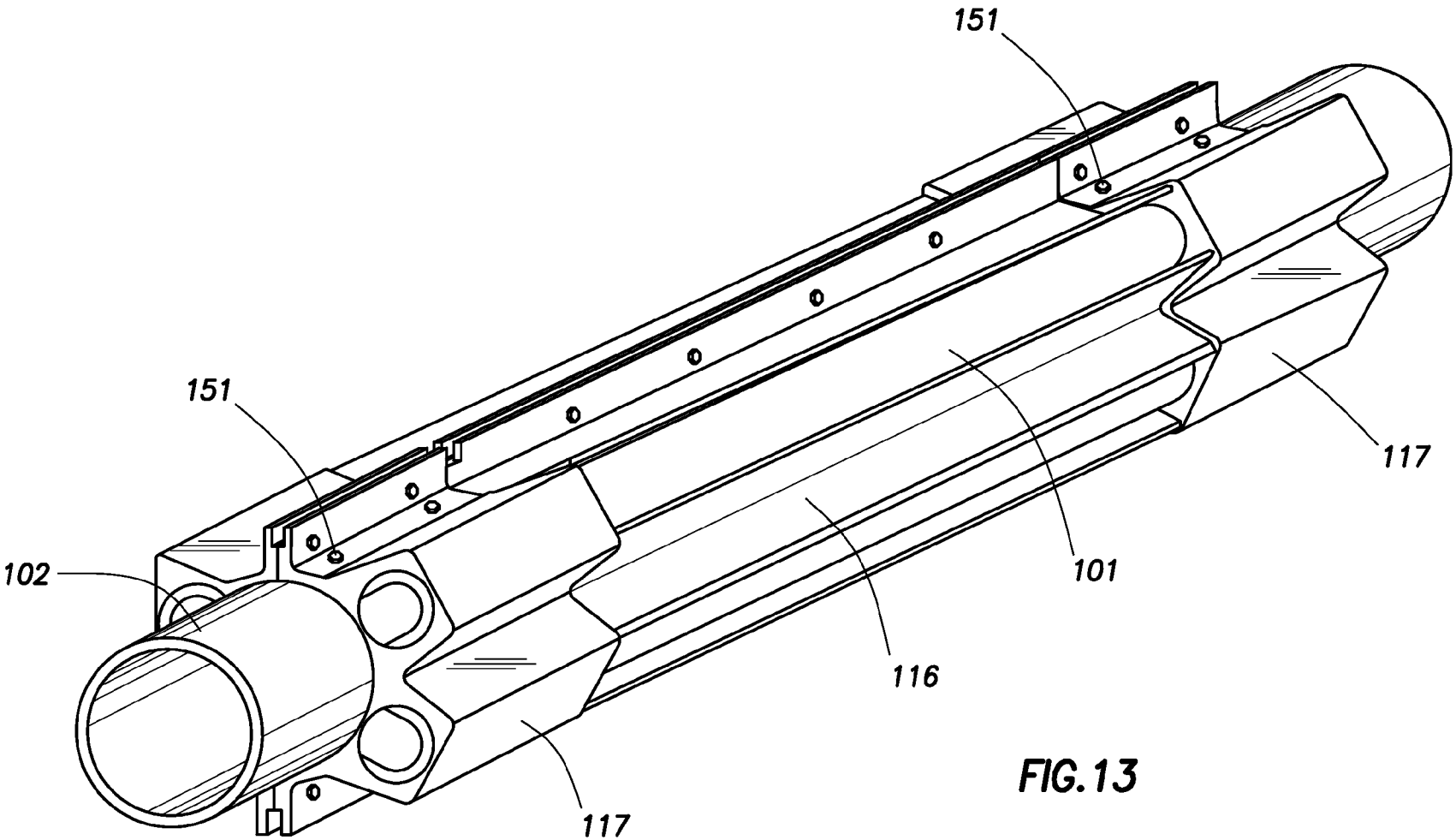

FIG. 13. is a perspective view of the carrier, clamp, and pressure chambers connected to the casing.

Upon installation of the casing within the ground, a number of casing segments are run into the well bore after it has been drilled in a manner known to those skilled in the art. Cement is then typically poured around the casing to fill in an annular space or gap between the outer diameter of the casing and the well bore. Hydrostatic pressure created by any fluid in the well bore, e.g., mud, brine, or wet cement creates pressures that might damage gun components such as detonating equipment or charges. The protective chambers 101 of the present invention guard against such damage.

It is not necessary, however, that the present invention be used only in cemented completions. The casing conveyed perforating assembly of the present invention might also be used for uncemented completions. In such cases, cement is not placed around the casing.

Regardless of the application, each pressure chamber 101 is a tubular vessel of constant internal diameter. The vessel is capable of withstanding external well-bore pressure while maintaining atmospheric pressure within. Each pressure chamber 101 should be constructed of a material resistant to abrasion and impermeable to well-bore fluids. It should also be resistant to chemical degradation under prolonged exposure to well-bore fluids at bottom hole temperature and pressure. These chambers 101 may be either metallic or non-metallic in nature and are sealed at both ends by end caps 115. The chamber 101 should be configured so as not to rotate. It should be non-rotating so as to maintain the orientation of its contents constant, relative to the surface of the casing. It should also have an internal diameter not less than that required to accommodate one or more shaped charges 104.

Figure 9A:
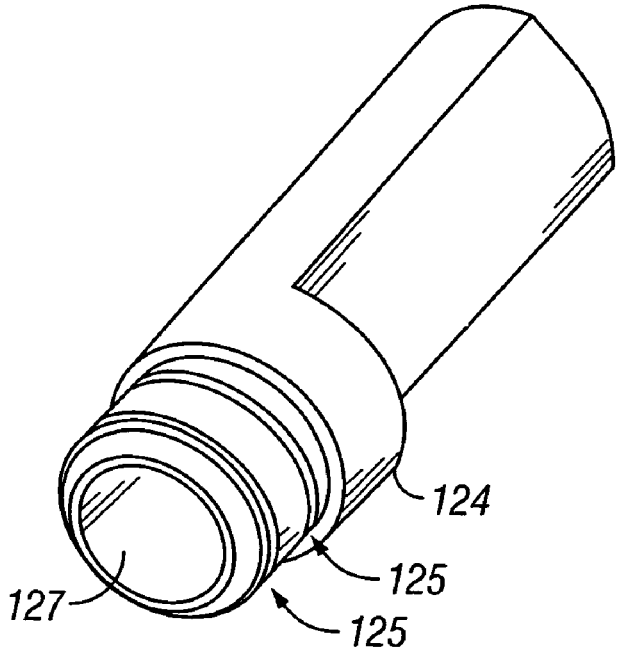
FIGS. 9A-D show the end cap of the present invention.
Figure 9B:
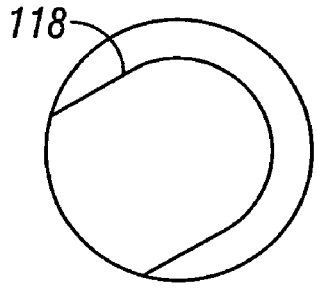

The preferred embodiment of pressure chamber 101 is a tube having a circular cross-section. It is manufactured of composite material, e.g. carbon fiber winding saturated with a thermoplastic resin. It is held in position relative to the casing by a carrier 116 and secured in position by a clamp 117. The chamber is made non-rotating as a result of a square profile 118 on its end caps 115 (See FIG. 9B), which are held in place by matching profiles on clamp 117 or by grooves cut into the end cap 115, into which set screws are secured through the clamp 117.

Figure 9C:
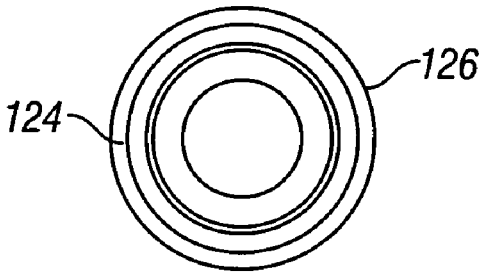
Figure 9D:
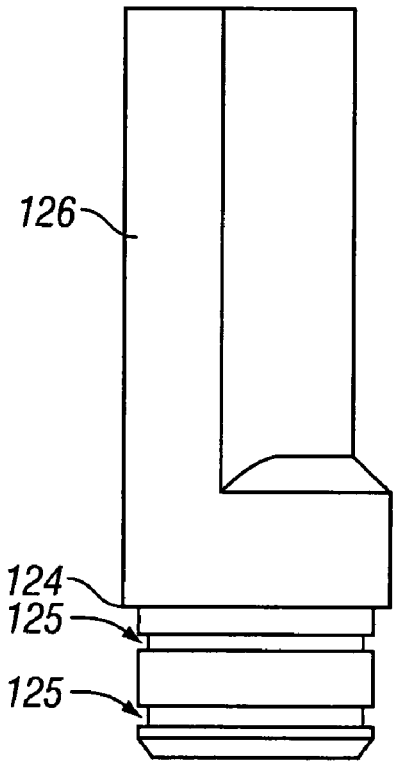

The end caps 115 form plugs to seal the end of the pressure chamber. See FIGS. 9A-D. Each has a profile 124 (See FIG. 9C) that allows its insertion to a fixed distance into the pressure chamber 101. One or more sealing elements 125 (O-rings) provide pressure isolation between the inside of the pressure chamber and the outside. Profile 126 is configured so that when it is secured by clamp 117, it prevents rotation of the pressure chamber 101 relative to the casing 102. Each end cap 115 also has an internal bore 127 along its axis. Bore 127 does not penetrate entirely through the plug. This enables ballistic transfer devices, such as receiver charge 120 or booster charge 121, to be fixed within each end cap 115. The end caps 115 may be metallic or non-metallic in nature. Preferably, end caps 115 should be constructed of composite materials. Such composite articles such as the pressure chamber 101 and end caps 115 may be supplied by Airborne Products, BV located in the city of Leidschendam, Netherlands.

Inside each of pressure chambers 101 is a flat metal strip 103. Strip 103 may be seen in FIGS. 5 and 8. Strips such as the one used here (at 103) are known in the art. They are typically used within hollow carrier perforating devices in the oilfield. Minimized portions 80, 82 on each strip are received in the each end cap 115. Slots 119 in the end caps 115 hold the strip so that it may not rotate within the pressure chambers. Thus, strip 103 is secured within pressure chamber 101. Holes are machined into strip 103 so that it can accommodate the shaped charges 104. Slots are machined into strip 103 in order to accommodate the detonating cord 105 used to provide ballistic transfer between the shaped charges 104 and between the ballistic transfer devices 120, 121 contained in the end caps 115.

Figure 5:
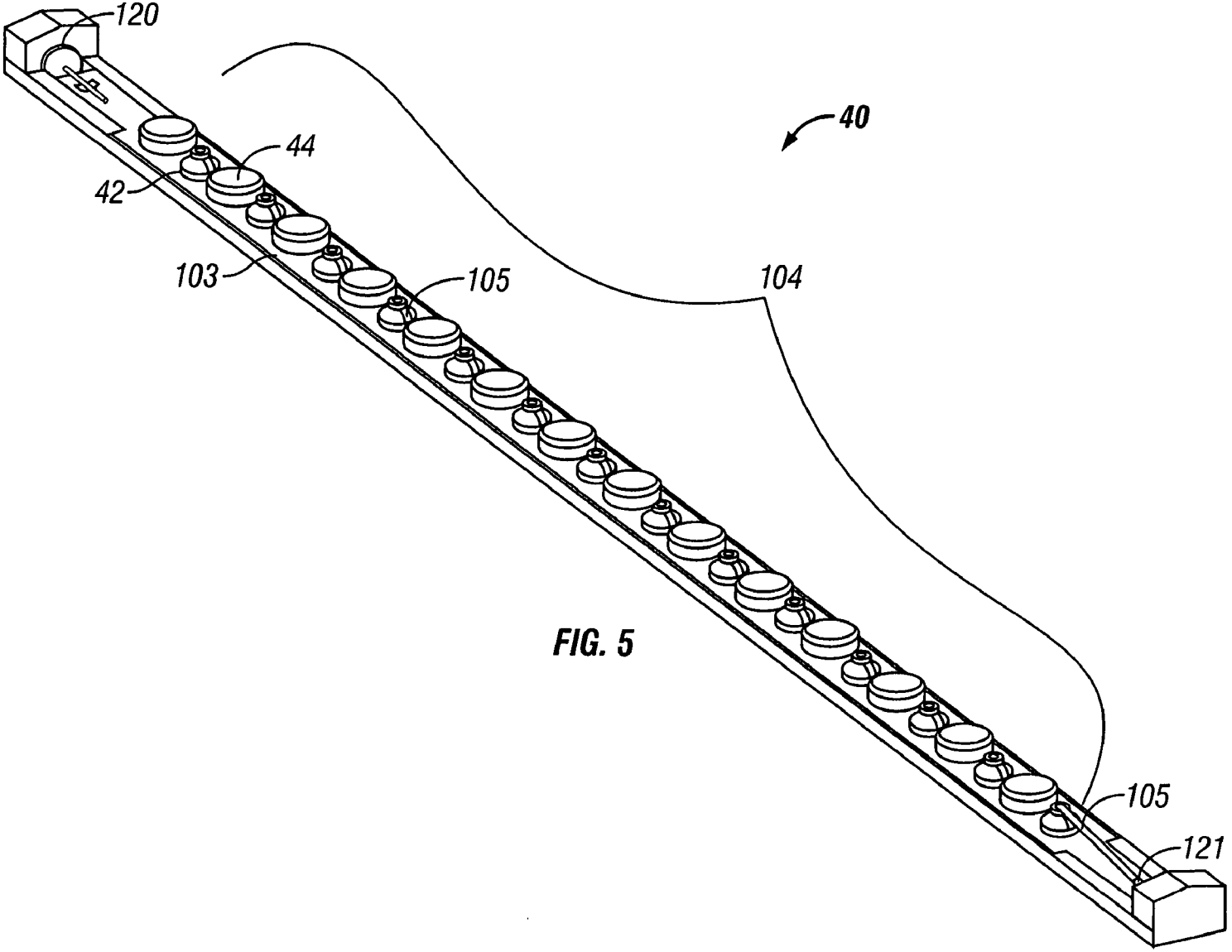
FIG. 5 is a perspective view of the perforating gun assembly of the present invention.

The charges 104 are located in strip 103 in two groups. One grouping 42 of charges 104 (as shown in FIG. 5) face inward toward the casing 102, whereas the charges in a second grouping face outward into the formation. The charges in the two groups 42 and 44 are alternatively spaced. It has been learned that different kinds of charges are better used for blasting into metal surfaces (such as casings) and other kinds of charges are better for blasting into rock formations. As can be recalled from the background section above, the conventional perforation gun techniques require the shaped charges to penetrate both the metallic casing and rock formations. Because the gun assembly 40 of the present invention allows the charges of the first group 42 (the ones used to perforate the casing) to be different than those of the second group 44 (the ones used to perforate the formation), the user may select the charge most appropriate for each.

Charges such as those used here are typically metallic in nature, containing pressed explosives and a pressed metal or forged liner, creating a shaped explosive charge, as is typically used in oilfield perforating devices. When ignited, they will create a hole of specific dimensions through the material into which they are fired. These charges must be maintained in an environment of low humidity and at atmospheric pressure. This is accomplished by the pressure vessel, which protects the charges from subterranean fluids, and the tremendous pressures encountered within the well bore. The charges of the first group 42 will perforate through the pressure chamber, the frame, and through the adjacent wall of the casing. These shaped charges will not, however, damage in any way the wall of the casing diametrically opposite from the point of perforation. The charges of the second group 44 will perforate through the pressure chamber and through any surrounding cement sheath and into the adjacent rock formation. This may be perpendicular or tangential to the surface of the casing, or form any other angle thereto.

Figure 10:
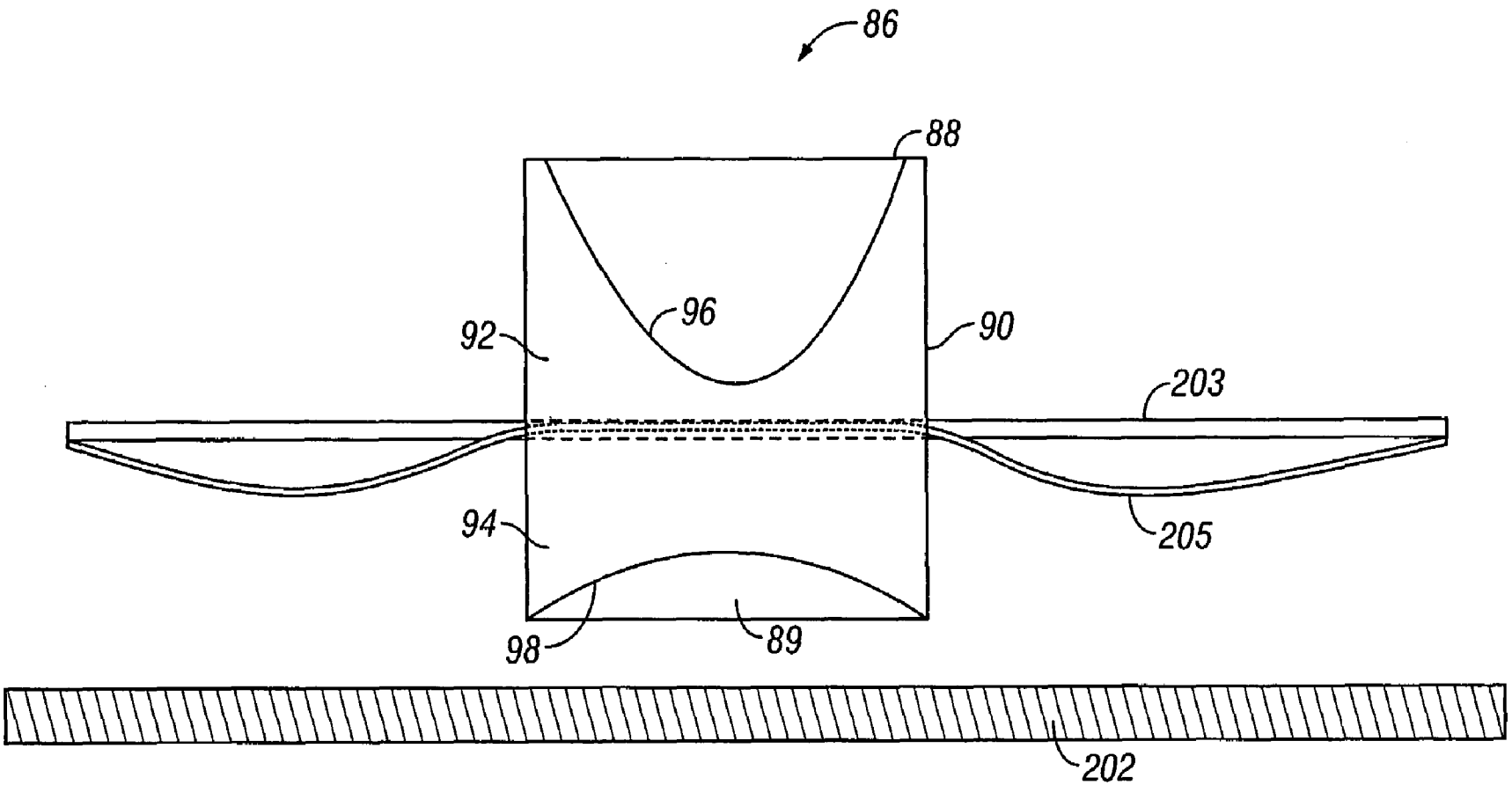
FIG. 10 shows an alternative bi-directional charge that may be used with the present invention.

In an alternative embodiment, all of the charges 104 shown in FIG. 5 are instead bi-directional in nature, having both inward and outward-firing components so as to fire two separate shaped charges in opposite directions simultaneously. Referring to FIG. 10, the bi-directional charge 86 of the present invention is contained in a charge capsule 90. A first, larger charge component 88 is aimed in the direction of the formation 81. A second, smaller charge component 89 is aimed inward towards the well-bore casing 102. Both charge components 88 and 89 comprise pressed explosives that are contained within shaped liners 92 and 94. Liners 92 and 94 have liner profiles 96 and 98 that serve to ideally direct the explosive perforating jets emitted after detonation. As can be seen from the figure, the outwardly fired charge component 88 is much larger than the inwardly fired charge component 89. This is to maximize penetration into the formation using a larger charge component 88, while providing the minimum required explosive mass to satisfactorily penetrate the casing wall. Because much less penetrating force is necessary to pierce the well-bore casing 102, the charge component used for this purpose 89 is much smaller. This limitation in the explosive force created also prevents damage of any kind to the wall of the casing diametrically opposite from the point of perforation. The bi-directional charges 86 in FIG. 10 are arranged on a metal strip 203 in the same manner, as were the charges 104 shown in FIG. 5. They are also associated with a detonating cord 205 in much the same way—except that with the embodiment in FIG. 10, the cord 205 bisects pressed explosives 92 and 94. These bi-directional charges may be arranged in any pattern within the pressure vessel and are maintained in an environment of low humidity and at atmospheric pressure by means of the pressure vessel. Like the first embodiment, the charges are maintained in ballistic connection by means of the detonating cord.

In either embodiment, a common detonating cord 105 interconnects the charges. Referring to FIG. 5, the cord 105 is seen being threaded through the metal strip via slots prepared for that purpose and being secured to ballistic transfer devices 120 and 121 within the end caps. Cord 105 is used to simultaneously ignite all the charges 104 on the strip to perforate the casing and well in response to an electrical charge. Detonating cord 105 may be any explosive detonating cord that is typically used in oilfield perforating operations (and other applications, such as mining). The cord chosen should also have the capability to provide ballistic transfer between an electronic detonator and a ballistic transfer device, between ballistic transfer devices, and between ballistic transfer devices and shaped charges. Detonating cords such as those used in the present invention are well known in the art. The present embodiment uses a cord (when used in a pressure chamber) that is formed of RDX or HMX explosive within a protective coating.

The pressure chambers also include a means for propagating ballistic transfer 120, 121 to another pressure chamber positioned above or below. At the other end of assembly, a booster charge 120 is used to receive ballistic transfer from either another pressure chamber or a detonating device 107 positioned above or below.

Figure 6B:
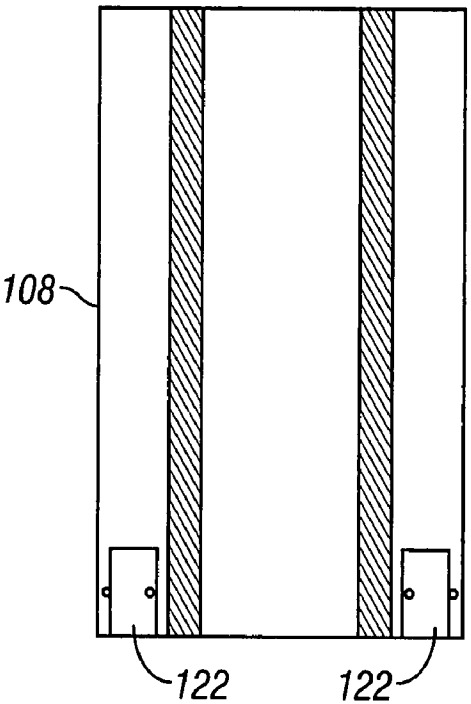
FIG. 6B is a side view of the firing head of the present invention showing the receptacles.
Figure 6A:
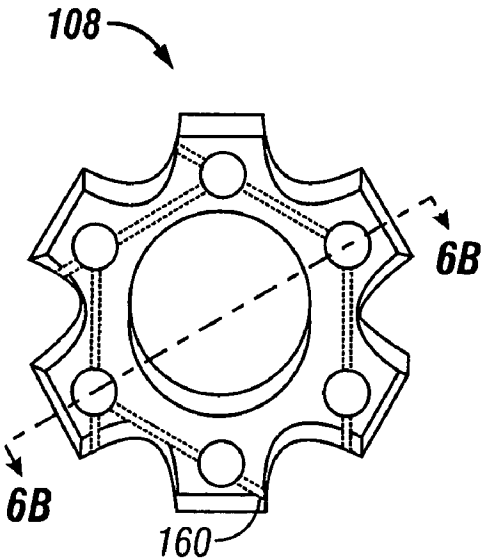
FIG. 6A is a cut view of the firing head of the present invention.

Referring to FIG. 6, a firing head 108 is also provided, in one respect, to secure each chamber 101 of an array chambers 101 surrounding the casing. Each firing head 108 is also used to detonate a booster charge 120 in each pressure chamber 101. The firing head is a machined body that fits around the outside of the casing. The firing head 108 ports 160, fittings and receptacles (not shown) to allow the installation of electrical devices within a pressure chamber while providing requisite electrical and ballistic connections to the outside of each chamber 101. The firing head also includes a receptacle, or nipple 122, for each adjacent and aligned pressure chamber 101, each nipple containing a ballistic transfer device (not shown) for activating the receiver charge 120. The firing head 108 may be secured to the casing by any known means, such as grub screws, so that it cannot rotate or move laterally along the casing. The firing head is normally constructed to be metallic in nature and has a number of connection points 123 for the admission of signals from a telemetry device on the surface.

The firing head is controlled using a telemetry system (not shown). The telemetry system may be any of a number of known means of transmitting signals generated by a control system outside the well to the electronic devices located in the firing head(s) inside the well, and signals transmitted by the electronic devices to the control system. It may use signals that are electronic, electromagnetic, acoustic, seismic, hydraulic, optical, radio or otherwise in nature. The telemetry system may comprise a continuous device providing a connection between the firing heads and the wellhead (e.g. cable, hydraulic control line or optical fiber). It also includes a feed-through device to allow the continuous connection device to pass through the wellhead without creating a leak path for well-bore fluids or pressure. It may be secured to the outside of the casing to prevent damage while running in the well bore. The telemetry system is connected with the internal components of the firing head via connector 109. Alternatively, the well-bore casing could be used as a conductive path.

Non-continuous transmittal means for the detonating signals may also be used. A non-electric detonating train comprising Nonal or an equivalent material may initiate the signal. The use of electrical or other continuous means to initiate the explosive charges (or used to "back-up" a continuous means) may cause the device to be susceptible to short-circuit as a result of leakage. Where several devices are to be connected in series, the risk of failure increases with the number of down-hole connections. The use of a non-continuous means to conduct the initiation process means that fluid ingress at any leaking connector becomes non-terminal.

Regardless of whether continuous or non-continuous means are used for signal transmission, the system transmits signals at a power level that is insufficient to cause detonation of the detonating device or shaped charges.

Figure 7:
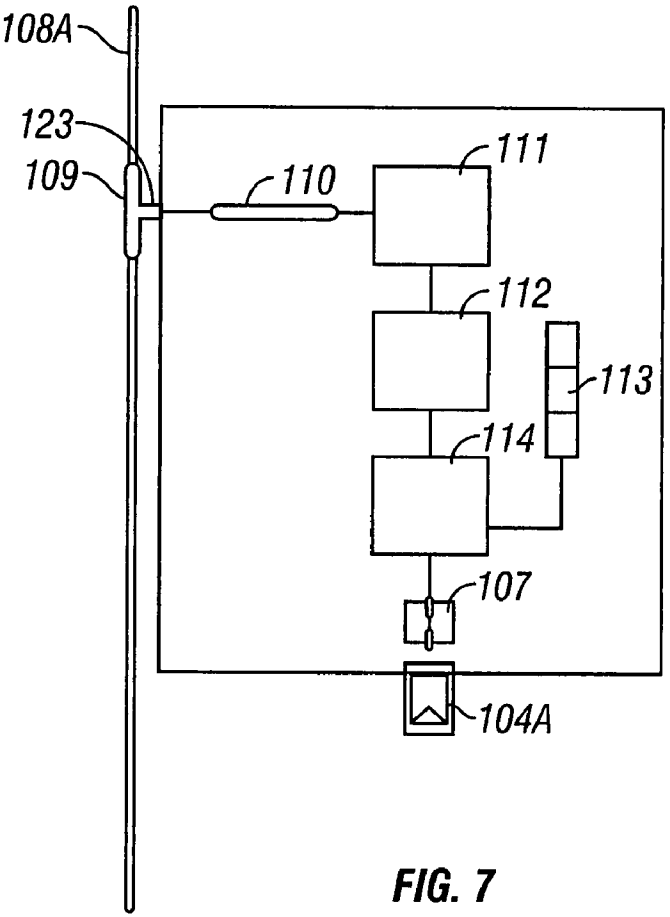
FIG. 7 is a schematic diagram showing the electrical components of the firing head.

A schematic diagram showing the electronic features of firing head 108 is provided in FIG. 7. The physical embodiment may be seen in FIG. 6. Referring first to FIG. 7, a signal is received from the surface though a signal conduit. The signal is in the form of a recognizable sequence of impulses that are generated by a control station located outside the well. They are typically transmitted using a telemetry system on the surface and then relayed to the electronic receiving device 112 inside the firing head 108 via the electrical connector 109 and electronic connection point 123. These impulses are recognized by the electronic device 112 as matching a pre-programmed specification corresponding to a command to execute some pre-determined action.

Electrical connector 109 is a device via which signals transmitted by the telemetry system on the surface are connected to the firing head electronic connection point, via which they are communicated to electronic devices within the firing head. The connector 109 has at least two coaxial conductors and two or three terminations, forming either an elbow or T-piece configuration. The connector also provides continuity of each of the at least two conductors to each of the two or three termination points. The body of connector 109 may be metallic or non-metallic in nature, being typically either steel or a durable composite (e.g., the composite known by the acronym "PEEK").

Besides connector 109, other electronic features shown include a transmitter/receiver for transmitting or receiving a signal to or from the surface, with an isolating device 110 to prevent short-circuit of a telemetry system 111 after detonation of the firing head.

Isolating device 110 is used to isolate the electronic connector 109 to which it is attached from any invasion of conductive fluids, such that electrical continuity at and beyond the connector is maintained even though the conductive fluids have caused a short circuit at the isolating device. It is used to maintain electrical continuity of the telemetry system after detonation of the firing head within which the isolating device is contained. An isolating device is necessary because well-bore fluid will enter the spent firing head, causing short-circuiting of the electronic devices within the firing head, which are in electrical connection to the telemetry system via the isolating device. Isolating devices such as the one disclosed at 110 are known in the art and are commercially available.

An electronic processing device 112 is also provided. It is used to interpret signals from surface and then transmit signals back to the surface. Electronic processing device 112 is a microprocessor-based electronic circuit capable of discriminating with extremely high reliability between signals purposefully transmitted to it via the telemetry device and stray signals received from some other source. It is also capable of interpreting such signals as one or more instructions to carry out predetermined actions. It contains known internal devices that physically interrupt electrical continuity unless predetermined conditions are met. These internal devices may include a temperature switch, a pressure switch, or a timer. Once a particular condition is satisfied (e.g., a particular temperature, pressure, or the elapse of time) the internal device creates electrical continuity. Once continuity has been created, the resulting electrical connection is used to initiate one or more pre-determined actions. These actions may include (i) initiating the firing of an electronic detonating device via electronic high-voltage device 114; (ii) the transmission of a coded signal back to the telemetry device, the nature of which may be determined by the state of one or more variable characteristics inherent to the processing device; and/or (iii) the execution of an irreversible action such that the electronic processing and/or high-voltage device(s) are rendered incapable of initiating the electronic detonating device. The preferred embodiment of processor 112 is manufactured by Nan Gall Technology Inc. and is easily modified to perform in the manner described above, said modifications being well within the skill of one skilled in the art.

The source of voltage necessary for detonation is drawn from a power source 113. Power source 113 comprises one or more electrical batteries capable of providing sufficient power to allow the electronic devices within the firing head to function as designed until at least the design life of the system. The battery or batteries selected may be of any of a number of known types, e.g. lithium or alkaline. The power source 113 is housed within firing head 108. They may also optionally be rechargeable, in a trickle-charge manner, via the telemetry system.

An electronic high-voltage device 114 is used to deliver the elevated voltage necessary for ignition by transforming the low voltage supply provided by power source 113 (typically less than 10 volts) into a high-voltage spike (typically of the order 1000V, 200A, within a few microseconds) appropriate for detonation of the electronic detonating device. Such a device is known to those skilled in the art as a "fireset" or "detonating set." Device 114 is housed within firing head 108. The electronic high-voltage device 114 used in the preferred embodiment is commercially available and is manufactured by Ecosse Inc.

An electronic detonating device 107 is triggered when the appropriate signals are transferred to the firing head through connector 109. After processor 112 interprets detonation signals, a charge from battery 113 is transmitted through the electronic high voltage device 114 to the detonating device 107.

The detonating device 107 is what triggers the detonating cord 105 that detonates the charges 104 within the nipples on the firing head. The electronic detonating device 107 generates a shock wave on application of electrical voltage of the appropriate waveform. It typically comprises a wire or filament of known dimensions, which flash vaporizes on application of high voltage. An example of one form of detonator that may be used is referred to by those skilled in the art as an exploding bridge wire (EBW) detonator. Such detonators are typically packaged together with an electronic high-voltage device such as the one shown at 114 in FIG. 7. Other kinds of detonators known to those skilled in the art will also work, however.

Figure 8:
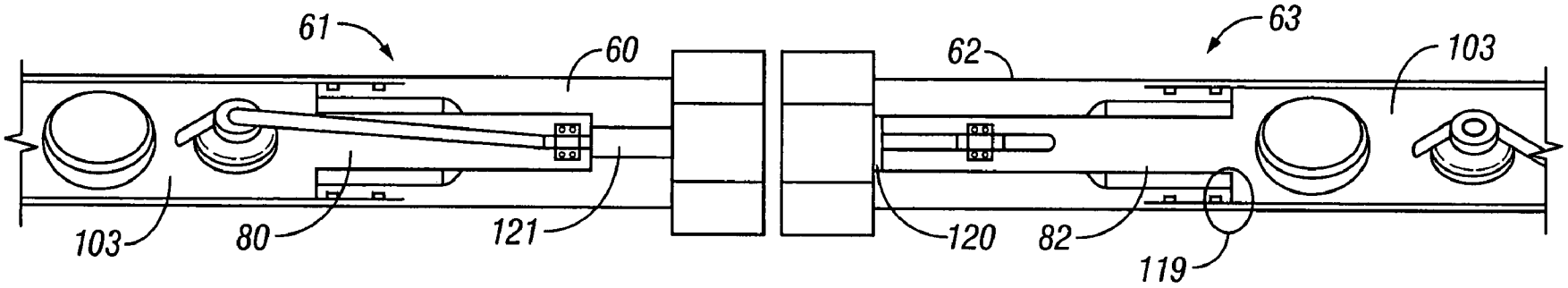
FIG. 8 is an end-to-end view from above showing the insides of two adjacent pressure vessels.

Not all of the pressure vessels are detonated using detonating devices such as that shown in FIG. 7. Instead, ballistic transfer may fire these pressure vessels. This is accomplished using one detonating device that initiates a ring of detonating cord. This ring of cord then initiates shaped charges in the nipples of the firing head. These charges in the nipples then initiate the uppermost pressure chambers via ballistic transfer across the known gap between the firing head nipples and the pressure chamber end caps aligned below them. Once the upper pressure chambers are ignited, ballistic transfer is used to propagate a detonation shock wave across the interruption in the detonating cord between the upper and next lower gun assemblies. FIG. 8 shows this arrangement. Referring to the figure, a ballistic transfer arrangement enables the detonating cord 105 of a gun assembly of a first (upper) pressure chamber 61 to be in shock-wave communication with the detonating cord 105 of another gun assembly in a second, lower pressure chamber 63. Booster charge 121 at the lower end 60 of the upper pressure chamber 61 is axially aligned and separated by a known distance from an upper end 62 of the second pressure chamber 63 containing receiver charge 120. The arrangement must be such that the axis of the pressure chambers 61 and 63 are be aligned so that the shock wave generated by the ignition of the gun assembly in the first pressure chamber is transferred from the booster 121 in the first chamber 61 to the receiver 120 in the second chamber. Booster charge 121 and receiver charge 120 may be contained either in the firing head or in the pressure chamber end caps. The use of boosters and receivers in successive chambers may be used to reliably allow the continued propagation of the detonation shock wave from the firing head to an adjacent pressure chamber, or from one pressure chamber to the next.

Figure 11A:
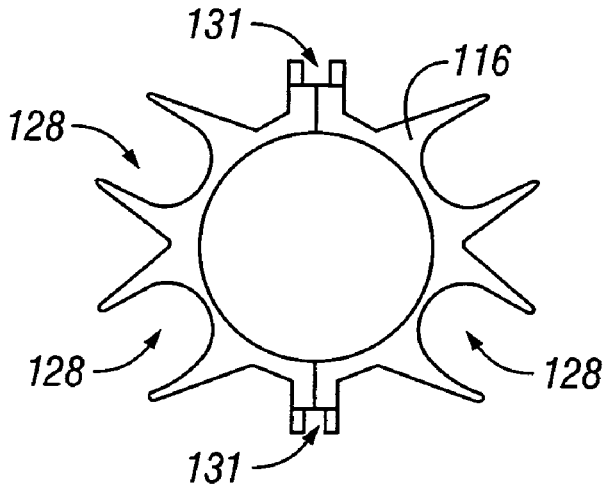
FIG. 11 shows several views of the carrier of the present invention.
Figure 11B:
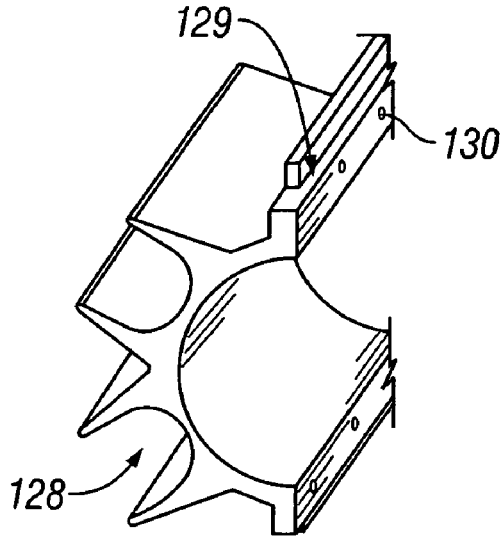

The carrier 116 of the present invention, as can be seen in FIGS. 4 and 11, comprises a machined part, fitting around the outside of the casing 102. Pre-formed channels 128 on the exterior of carrier 116 receive the tubular pressure chambers 101. Each carrier has profiles 129 at either end to accommodate clamps 117, which will be discussed hereinafter. Each carrier 116 comprises two hemi-cylindrical parts, secured one to the other along the edges by bolts, for which bolt holes 130 are provided. A plurality of longitudinal canals 131 are defined by the structure of the carrier 116. These canals 131 create a protective space in which a continuous medium such as cable, control line or fiber can be deployed without being vulnerable to damage when the shaped charges are detonated. It is often desirable to deploy a cable, fiber or tube along the length of a well bore for connection to, or to act directly as, a sensing device. By deploying these items in the protective canals 131, they are kept away from the jets created by an exploding charge.

The carrier may be constructed of metallic or non-metallic materials. The material used in the preferred embodiment is aluminum. The length of the carrier is equal to that of the pressure chambers with end caps inserted, allowing for a pre-determined separation between the end cap of one pressure chamber and that of the next pressure chamber mounted adjacent to it along the casing.

Figure 12A:
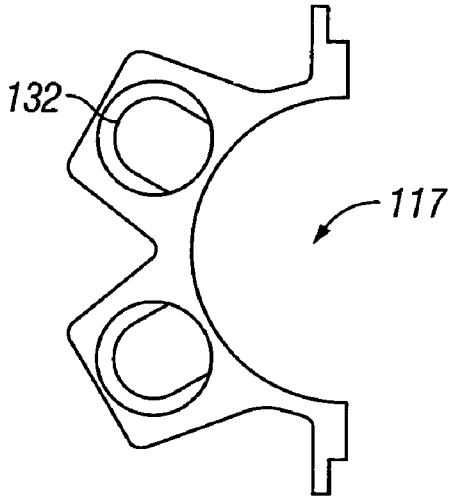
FIG. 12 shows several views of the clamp of the present invention.
Figure 12B:
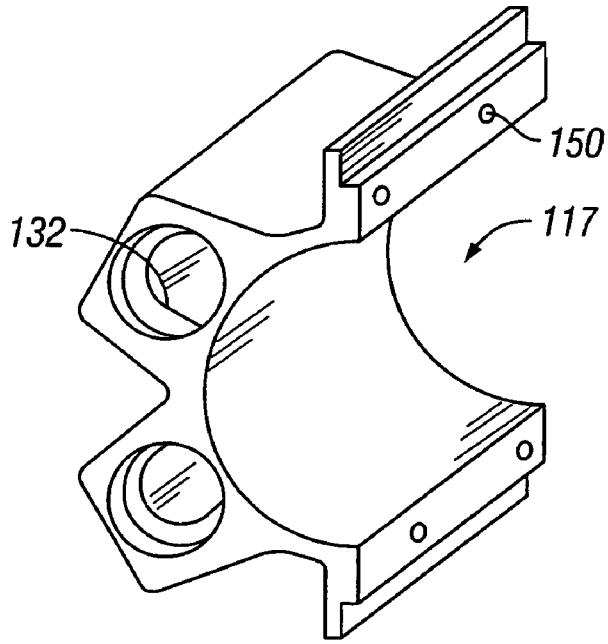

A pre-formed clamp 117 is used for securing pressure chambers and carriers to the casing. See FIG. 12. Clamp 117 is attached to the casing 102 and a profile 132 matching that of the end caps 115 such that the end caps are secured and cannot rotate or move laterally or longitudinally relative to the casing 102. The outer diameter of clamp 117 should be no greater than that of carrier 116 when mounted on the casing 102. Like carrier 116, clamp 117 comprises two hemi-cylindrical parts, secured one to the other along the edges by bolts (not pictured), for which bolt holes 150 are provided.

The above design enables easy installation. First, the equipment is easily installed on the outside of the casing as described above. Once this has been completed (the pressure chambers 101 have been installed in the pre-formed channels 128 of the carriers 116, the end caps 115 have been secured and the pressure chambers locked into place longitudinally by the clamps 117 with the charges 104 appropriately placed therein), the entire casing with attached gun assembly may be run down the well bore. The perforating assemblies are modular so that a large number of assemblies may be connected end to end, with ballistic transfer arranged from one to the next for perforation of long intervals. For shorter intervals, fewer modules will be used.

A pre-formed clamp 117 is used for securing pressure chambers 101 and carriers 116 to the casing. See FIG. 12. Clamp 117 is attached to the casing 102 and a profile 132 matching that of the end caps 115 such that the end caps are secured and cannot rotate or move laterally or longitudinally relative to the casing 102. The outer diameter of clamp 117 should be no greater than that of carrier 116 when mounted on the casing 102. Like carrier 116, clamp 117 comprises two hemi-cylindrical parts, secured one to the other along the edges by bolts 151, for which bolt holes 150 are provided.

FIG. 13 shows how clamp 117 is used to attach pressure chambers 101 and carrier 116 to casing 102. Clamp 117 covers end caps 115 so that they cannot move relative to casing 102.

Once the casing is properly positioned within the well bore, cement is circulated into the annular space between the outer surface of the casing and the well bore wall by means generally well known to those skilled in the art. The cement circulates freely through longitudinal channels created between each longitudinally shaped fin (spine-fins), said fins comprising the pressure chambers 101 and associated components. Although circulation is not impaired by a straight finned embodiment, it could, however, be enhanced by a helical embodiment.

If the fins on the casing are formed in a helical shape, instead of longitudinally as shown in FIGS. 4-12, they will induce turbulence when the cement is circulated through the annular space. Turbulence created by the circulating cement forces mud and other substances to the surface where they are preferably removed. Otherwise, when the cement hardens, the mud that has not been displaced will inhibit the formation of a seal between the casing and the formation. Therefore, forming the pressure chambers on the outside of the casing in a helical design can enhance the desired sealing properties of the cement.

Additionally, the spine-finned or helical design inherently reduces the amount of annular space thus, placing the spine fins in closer proximity to the formation. Because this arrangement of charges requires less annular space between the outer surface of the casing and the well bore, less cement is required thus, further reducing costs. As a result, smaller charges are needed to perforate though the cement into the formation. This advantage is even greater for the inwardly projecting charges that do not have to penetrate the cement before perforating the casing.

If the fins on the casing are formed in a helical shape, instead of longitudinally as shown in FIGS. 4-13, they will induce turbulence when the cement is circulated through the annular space. Turbulence created by the circulating cement forces mud and other substances to the surface where they are preferably removed. Otherwise, when the cement hardens, the mud that has not been displaced will inhibit the formation of a seal between the casing and the formation. Therefore, forming the pressure chambers on the outside of the casing in a helical design can enhance the desired sealing properties of the cement. the present invention may be fired in any order, the user is able to optimize multiple formations during the life of the well. The result is increased productivity.

Of course, alternative embodiments not specifically identified above, but still falling within the scope of the present invention exist.

For example, the tool may also be embodied such that the pressure chamber and carrier are formed as one integral component. Additionally, an injection molding could be used providing all of the features described above as being part of the pressure chamber and the carrier. Resin transfer molding could be used for the same purpose, as could any other comparable process for manufacturing such solid bodies.

Attaching the internal components to the well bore casing by any known means, such as applying adhesive, could also embody the tool. In such a case, the pressure chambers could be formed when epoxy resin, or other such material that cures into a hard solid, is poured over and around the components within a pre-formed mold.

It is also possible that the present invention could be used equally well in situations in which the perforating assembly is attached to a tubular that is not cemented into the well bore. When drilling certain hydrocarbon bearing formations, the invasion of drilling fluids into the formation causes significant damage to the near-well-bore region, impairing productivity. In situations where cementing and perforating a casing is undesirable, various means are used to avoid and/or remove such damage such as under-balanced drilling, exotic drilling fluids and clean up or stimulation fluids. In addition a pre-drilled or slotted liner may often be run to preserve well bore geometry and/or prevent ingress of formation material. The present method provides for a cost-effective way to bypass the damaged zone by perforating the formation and casing without cementing the casing in place using the perforating assembly in the same manner as described above, except that the step of cementing the casing (or portions of the casing) is eliminated.

It is also possible that the pressure chambers could be disposed on the casing in some other configuration other than the spine-shaped fin configuration disclosed above. For example, as mentioned briefly above, they could be formed helically (instead of longitudinally) on the exterior of the casing. Such a particular configuration would have the turbulence promoting advantages desired upon circulation of cement into the annular space between the casing and well bore.

Although the invention has been described with reference to the preferred embodiments illustrated in the attached drawing figures, and described above, it is noted that substitutions may be made and equivalents employed herein without departing from the scope of the invention.

What the invention claimed is:

1. A carrier assembly for a perforating device, the perforating device causing the perforation of a subterranean earth formation through a wellbore, the carrier assembly comprising:

a carrier;

a clamp for securing the perforating device to a casing; and a plurality of fasteners for securing the carrier to an object within the wellbore; wherein the carrier comprises a first section and a second section, at least one of the first section and second section comprising a longitudinal channel for receipt of the perforating device, the first section and second section forming a plurality of longitudinal canals for receipt of a signal transmission means when the first section and second section are secured to the casing; wherein the perforating device comprises a sealed pressure chamber and a gun assembly contained therein.

2. The carrier assembly of claim 1, wherein the object is casing and the carrier is secured to an outside surface of the casing before it is lowered into the wellbore.

3. The carrier assembly of claim 1 wherein the clamp comprises a first section and a second section, each first section and second section attached to a respective end of the first section and second section of the carrier by at least one of the plurality of fasteners.

4. The carrier assembly of claim 3, wherein the plurality of fasteners comprise a plurality of bolts that are secured through respective openings in each first section and second section of the carrier and each first section and second section of the clamp.

* * * * *